US005216767A

United States Patent [19]

Elmore

[11] Patent Number: 5,216,767

[45] Date of Patent: Jun. 8, 1993

[54] DRAINAGE ENHANCER FOR DOUBLE SEEPAGE DRAINS

[76] Inventor: Mark C. Elmore, P.O. Box 51143, Amarillo, Tex. 79159

[21] Appl. No.: 903,607

[22] Filed: Jun. 25, 1992

[51] Int. Cl.[5] ..... A47K 3/00

[52] U.S. Cl. ..... 4/613; 137/362

[58] Field of Search ..... 4/596, 612, 613, 614; 137/362

[56] References Cited

U.S. PATENT DOCUMENTS

| | | | |
|---|---|---|---|
| 1,792,345 | 2/1931 | Williams | 137/362 X |
| 2,255,893 | 9/1941 | Mullet | 4/613 |
| 2,299,705 | 10/1942 | Svirsky | 4/613 X |
| 2,484,240 | 10/1949 | Northland | 4/613 |
| 2,859,452 | 11/1958 | Seewack | 4/613 X |
| 5,022,430 | 6/1991 | Degooyer | 137/362 |

*Primary Examiner*—Henry J. Recla
*Assistant Examiner*—Robert M. Fetsuga

[57] ABSTRACT

A device for improving the drainage through, and structural integrity of, a mortar bed of a shower floor. The device encircles a neck portion of a drain in the shower floor. The device is positioned between the mortar bed and drainage weep holes formed in the drain so that practically any water seepage through the mortar bed must pass through the device before entering the weep holes. The device has a greater porosity than that of the mortar bed and provides a larger drainage surface area of the mortar bed than that of the weep holes alone.

5 Claims, 3 Drawing Sheets

DRAINAGE ENHANCER FOR DOUBLE SEEPAGE DRAINS

1. FIELD OF THE INVENTION

Figure 1:
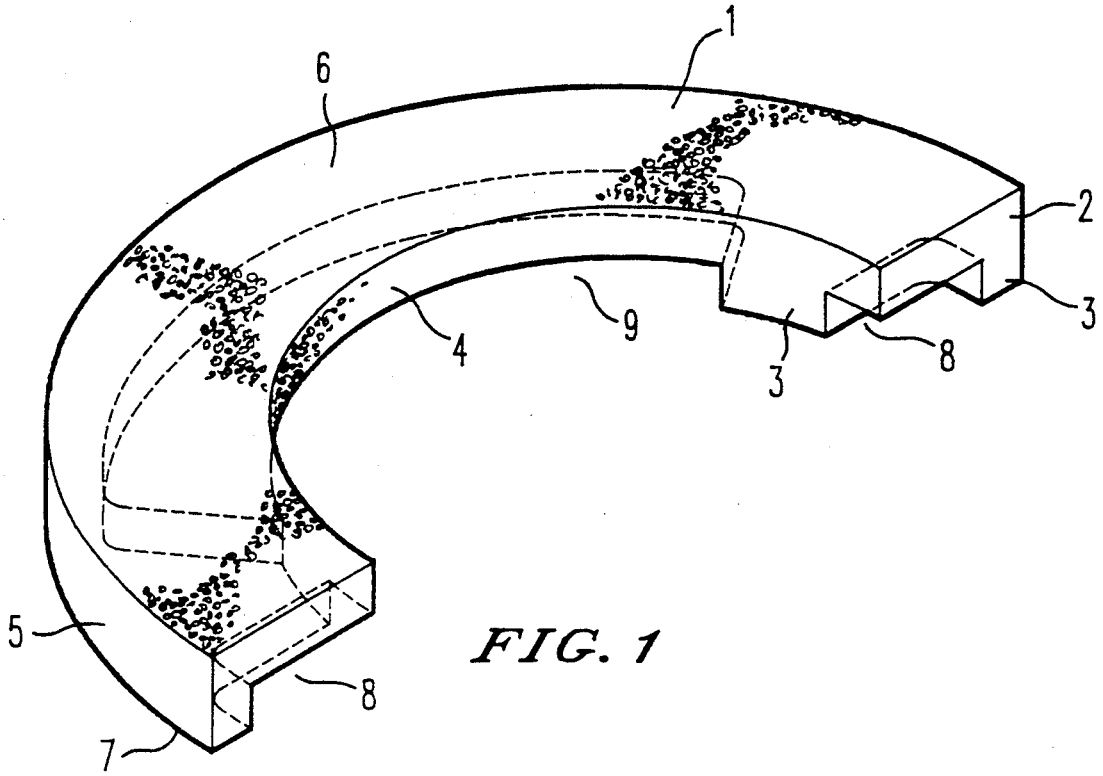

This invention relates in general to floor drains and in specific to enhancing the drainage of a mortar bed in conjunction with a double seepage drain.

2. BACKGROUND OF THE INVENTION

The construction of most shower floors typically consist of at least these components:

1) Shower subfloor.
2) Shower pan.
3) Mortar bed with or without aggregate.
4) Shower drain with feature for creating a watertight seal to pan. The drain should also incorporate drainage openings at the same approximate level of the pan for the purpose of draining the mortar bed. These openings are also known as "weep holes". This type of drain is often called a "double seepage drain".
5) Floor surfacing material, (most often ceramic tiles).

All of these elements should work together to produce a quality shower floor providing years of service without leaks or a weak floor. Each component is further defined as follows:

1) A subfloor is usually a concrete floor or a wood floor. Wood floors are most often encountered in pier and beam construction. However, the type of subfloor is irrelevant to this invention. The subfloor is mentioned because it provides the base which all the other elements of this discussion rest upon or within. For the shower pan to drain most effectively the subfloor should be slightly sloped toward the drain so that fluids on top of the pan will flow toward the drain. The most common method of achieving this slope is by "skim coating" or "floating" the subfloor with a thin layer of suitable mortar prior to covering with the shower pan. This coat of mortar is trowelled to the proper grade to give the proper slope to the subfloor.

2) The shower pan is most often a tough plastic sheet 20 to 40 mils thick. The most common plastic pan is 40 mils thick and generally is available in rolls of 4, 5 or 6 feet width. Lead sheets are sometimes used, and occasionally copper sheets are used. In a small percentage of installations a trowellable liquid material is used which cures to form a waterproof membrane.

Other types of waterproofing exist, but by far the most widely used waterproofing for showers is the plastic sheet. It should be noted however, that the type of shower pan used is irrelevant. Any pan used in conjunction with a double seepage drain, will perform better if used with the invention disclosed herein.

One type of shower which commonly does not employ a drainage system such as the one discussed herein, is a shower commonly referred to as a "fiberglass shower". The fiberglass shower is normally a premanufactured unit where the floor is available as an integral or componentized part of the shower stall. The shower usually comprises a construction of resin and fibers. Normally this type of shower would not be considered a candidate for the use of the invention disclosed herein, since it would not typically use a double seepage drain.

3) The mortar bed comprises a sand and portland cement mixture which at the time of installation is placed over the shower pan as a damp, compactable, screedable, coarse material. It has a consistency much like that of a damp sand suitable for building a sand castle. It typically has three to six times as much sand as it does cement. It is not highly liquid or flowable like a concrete mixture typically seen poured into forms for a sidewalk or driveway.

The mortar bed material is often called a "dry pack" and has only enough water in it to hydrate the cement and make the mortar bed compactible. The mortar bed cures into a hard concrete base, suitable for supporting the overlaying tiles or other selected floor covering. Because of its large proportion of sand, the mortar bed remains very porous and will readily soak up water.

A mortar bed will typically vary in thickness anywhere from ¾ inch to 3 inches thick depending upon the preferences of the installer, the subfloor condition, and the height of the top of the drain above the shower pan. The thickness (i.e. height) of the mortar bed at the outside edge of the shower floor typically will be thicker than at the area of the mortar bed adjacent to the shower drain. This provides slope to the floor so that water will flow on the surface of the floor towards the floor drain (top of the double seepage drain).

Standard procedure is to incorporate a wire or plastic reinforcing mesh into a mortar bed horizontally to help hold it together. Although this is widely practiced in the construction of large mortar beds such as found in floors of large commercial kitchens, it is not widely practiced in the construction of shower floors. This is probably due to the fact that it is inconvenient to install and the size of the floor in a shower is generally not much over three feet by four feet. However most manufacturers of tile setting materials still recommend reinforcing small mortar beds such as a shower floor.

The mortar bed serves two main purposes. The first is to provide slope to the floor surface so it will drain as already mentioned. The second purpose is to provide a bedding surface for the overlying floor material to rest upon and bond to. For this type of shower construction the most common floor surface material is a ceramic tile, marble tile or marble slab(natural marble or man made).

The mortar bed rests on top of the shower pan, relying on the shower pan for waterproofing the floor of the shower. The mortar bed is itself very porous, contributing nothing to the waterproofing of the shower. In fact, if it is not properly drained, the mortar bed actually creates a waterproofing liability.

The mortar bed quickly soaks up any water that contacts it and will hold a considerable amount of water until it becomes saturated. If the mortar bed is properly drained then this liability is minimized. However if the mortar bed does not drain well, it will become a reservoir of water.

Should the pan develop a small leak then this reservoir of water slowly but continually seeps through the leak flowing into the subfloor and surrounding area. This escaping moisture can decay and destroy many of the other surrounding materials such as wooden studs in the wall, sheetrock and the overlying paint, wall paper or tile, carpeting or other flooring, wooden base and trim, wooden subloors, etc. These types of repairs can be quite expensive necessitating complete replacement of the shower bottom and any other damaged or stained materials in the home or building.

Usually this type of leak will flow continuously even between showering since the mortar bed will saturate quickly but deplenish slowly if the mortar bed drainage system is not working well. That is, the mortar bed will quickly soak up water while the shower is being used. If a small leak is present it is possible to slowly deplete the reservoir without depleting the mortar bed entirely before the shower is used again.

A large leak is usually noticed rather quickly, before much permanent damage is done, particularly to structural components of the building. Small leaks such as the one addressed herein, can and often do go unnoticed for months or years before they are noticed. By then the rot and moisture have often caused a great deal of damage. This type of leak can also encourage mildew and fungus growth to occur in carpeting, wood and other building materials which may cause or aggravate allergies, respiratory ailments or other health problems.

A leak in the pan located near the top of the mortar bed should theoretically allow only a negligible amount of water to pass through, if the bed drains well. That is, the saturation level in the mortar bed should drop fast enough to "in effect" avoid the leak, if the bed is properly drained.

Thus it is vital for the mortar bed to drain effectively in order to avoid or minimize a leaking problem. There is a practice that has been recognized for decades that should properly drain the mortar bed, but it is not in wide use. The practice involves constructing the mortar bed in such a manner as to help water to flow from the mortar bed into drainage openings located at the base of the drain for the purpose of draining the mortar bed. This practice will be expounded upon after discussion of component #5.

4) Typically the drain is designed to fulfill three main purposes, (A) achieving a water tight connection to the shower pan, (B) providing drainage to the mortar bed and (C) draining the shower floor or other wet surface.

This type of drain is sometimes called a "double seepage drain". For the purpose of this application the term "double seepage drain" shall refer to any type of floor drain which has a means for "double drainage". That is, it drains the floor surface while also allowing water to seep from a "setting bed" into the drain. The "setting bed" is most often a mortar bed but in some situations the bed may comprise loose sand, aggregate or some other type of filler.

In addition the drain incorporates "drainage openings" designed into the drain collar. These openings are usually holes, grooves, slots or other openings formed through the drain collar, or occasionally in the drain neck. They are sometimes known as "weep holes". For the purpose of this application the terms "drainage openings" and "weep holes" may be used interchangeably. This is while acknowledging that in some drains the openings may be grooves or some other type of opening other than what might be considered a "hole". However the term "weep hole" is descriptive in that it describes an opening which allows water to "weep" from the mortar bed into the drain.

The collar attaches to the drain flange sandwiching the shower pan between them, which creates a water tight seal. Some contractors will caulk the area between the pan and drain flange before installing the collar over the pan in order to get a better seal. The weep holes allow water from the mortar bed to drain through the collar and into the drain. The water on the top of the floor surface runs down through the top of the drain.

5) The floor surface material, as previously mentioned, is most often a tile of some type but there are other suitable materials. The tile or other floor material allows water to get into the mortar bed as it soaks through the grout joints between the tiles and at the intersection between the wall and floor. A commonly used tile for shower floors would be a 2 inch square tile, 4 inch hex shaped tile or other similar sizes.

Up until now, the best method of installing the mortar bed was to first place a pile of gravel or small pieces of broken tile around and above the weep holes located on the drain collar, prior to placing the mortar bed. This pile of aggregate served to provide better access for free water flow from the mortar bed into the weep holes, than just placing mortar directly over the weep holes. The aggregate would effectively allow more surface area of the mortar bed to be drained and would provide a highly porous substrate to allow fluid to flow freely to the weep holes.

The problem with this technique of placing the aggregate above and around the weep holes is that it is not widely practiced. The most common reasons for the lack of using aggregate over the weep holes are: lack of convenience, laziness, the mess of having to carry around gravel or break up tile, aggregate falling into the weep holes, and lack of stability in the mortar bed due to the loose gravel.

Whatever the various reasons might be for each neglectful contractor the fact remains that the majority of the showers built do not have the intended drainage construction in place. It is cumbersome to place the aggregate and keep them in place while installing the mortar bed over the pan and against the aggregate and drain. Since the loose aggregate is dimensionally unstable, it does not provide any solid support or stable backing for the adjacent and overlying mortar, either during the installation process or after it is cured. The mortar bed must be able to pack tightly against a firm surface during its placement in order to cure into a hard, stable material, and stay intact. The loose aggregate fails to provide a firm and stable surface.

However, all double seepage drains (known to this inventor) are designed to be dependent upon the aggregate for proper drainage and to function as designed. The whole double seepage drain industry is designed around the false assumption that all contractors are going to place aggregate over the weep holes of double seepage drains.

The loose aggregate further reduces the strength of the mortar bed by greatly reducing the depth of the mortar bed thickness in the area adjacent to the drain. There is nothing strong, continuous or dimensionally stable under the thin mortar bed in that area. Thus the integrity of the tile floor at that area is weakened. Often there are several small pieces of tile adjacent to the floor drain since small cuts have to be placed there in order to maintain the pattern of the floor tile. If loose agregate is placed over the weep holes, then these small tiles are often not bonded to anything strong, stable or solid and may come loose or even pull out of the floor. Though the reinforcing mesh will help deter this somewhat if used, it cannot completely overcome any of the various problems associated with the loose aggregate method.

In actuality the loose aggregate can contribute to clogging the drainage openings. The aggregate can fall into a weep hole and lodge there creating a partial or nearly complete obstruction of the opening. Some types of gravel which have a rounded shape will obstruct nearly all of a round or curved opening.

If an installer uses crushed tile pieces for the aggregate, he has little control over the sizes of the pieces he obtains from breaking the tile and thus has little control over what sizes of pieces will be placed over or fall into the weep holes. In addition the broken tile method can cause a leak to occur in the pan if it is punctured by a sharp piece of broken tile.

In general the aggregates commonly available to a tile contractor have had little or no grading done to them to sort the aggregate into appropriate sizes for use in this application.

In addition there is no convenient or practical way to prevent the aggregate from falling into the openings (weep holes) with this method. There needs to be a method or device for allowing the aggregate or other suitable drainage material to lay over and upon the openings without any particles falling into the openings, while at the same time not blocking access for water flow to the openings (weep holes).

Likewise, if no aggregate is used, very little water flow takes place into the weep holes and subsequently the mortar bed is not adequately drained. Furthermore if the mortar bed is allowed to come into direct contact with the weep holes, the fine particles and comparatively denser structure of the mortar bed effectively clog the weep holes. Even though the mortar bed is considered porous, for it to be effectively drained it should have a maximum surface area available for exposure to free water flow. The aggregate provides the free water flow and causes a greater surface area of the mortar bed to be exposed.

Even though the mortar bed is porous it would not be considered a medium for free water flow. Nor are the double seepage drains designed for the weep holes to come in direct contact with the mortar.

The need exists for a device that will be more readily and effectively used to solve this problem of draining the mortar bed, than the loose aggregate system. The lack of convenience and dimensional stability as well as the other problems already mentioned prove to be a great disadvantage of the loose aggregate method. These disadvantages lead to one of two possible unsatisfactory installations. If the loose aggregate is used then a lack of structural integrity and possible weep hole clog may occur. If in order to avoid the lack of structural integrity, and inconvenient hassle of obtaining and placing the loose aggregate, the installer chooses to place the mortar bed directly over the weep holes, then little or no drainage of the mortar bed will occur.

The weep holes that are currently manufactured in shower drains will not function as designed without a porous medium of some sort covering them. The medium needs to provide:

A) Free flow of water from the mortar bed to the weep holes.

B) Isolation of the weep holes from the mortar bed in order to keep the fine particles and more dense structure of the mortar bed from clogging up the weep holes.

C) A much greater surface area of mortar bed available for water drainage into the weep holes, than the surface area of the weep holes alone would provide.

D) Protection of the weep holes from aggregate or other particles falling into them and partially or completely obstructing them.

E) Protection of the weep holes from a large piece of material covering the weep hole and effectively sealing it off.

F) Convenience, low expense and ease in use for the installers so that the porous medium will be widely and properly used, therefore enabling the weep holes to perform as designed.

G) A strong, dimensionally stable, and continuous support for the surrounding mortar bed and overlaying tiles, creating a floor with structural integrity.

Whatever the precise merits, features and advantages of the loose aggregate method, it fails to adequately achieve or fulfill the purposes of the present invention.

3. SUMMARY OF THE INVENTION

In fulfillment and implementation of the previously recited objects, a primary feature of the invention resides in the provision of a unique inexpensive premanufactured drainage device of sufficient surface and interior porosity to allow maximum water flow from the mortar bed into the device, through the device and into the weep holes of a double seepage drain.

It is the obect of this invention to provide a porous medium drainage device which is more convenient, structurally superior, and offers more advantages than the current method of using loose (i.e. friable) aggregate. Although the present method of using loose aggregate provides the features of free flow of water and provides a greater surface area of mortar bed available for drainage than the weep holes alone, it does not provide isolation of the weep holes from the mortar bed particles, and it fails to protect the weep holes from clogging due to aggregate falling into them or covering them.

Another feature of the drainage device is that it is dimensionally stable and provides a solid and continuous support for the mortar bed as the mortar is packed against the device. It also provides a secure bond for the mortar bed which allows the overlaying mortar bed to remain intact. The loose aggregate method on the other hand, is inconvenient to place into postion and its friable nature creates a dimensionally unstable and unsatisfactory substrate for the overlying mortar.

"Dimensionally stable" shall be defined as a medium that is non-friable, intact, has a three-dimensional body that maintains its shape under stress (save for some possible flexibility as to be discussed later in the specification) and provides a continuous, supportive base contributing to a strong and solid mortar bed.

An additional feature of the dimensional stability of the drainage device is that the device is capable of laying over or bridging a weep hole opening without falling into, sealing over or clogging the openings.

One further advantage of the device porosity (i.e., water permeability) is that although the drainage device lays upon and covers the weep holes it still allows free water flow to the weep holes.

Another benefit of the drainage device is that it is composed as a medium of aggregates and/or particles and/or fibers and/or fibrous material which are selected and graded according to size and proportion and held together to form a homogenous three dimensional construction. The sizes and grades selected are chosen to maximize water permeability into and through the device, adequately support the mortar bed at the micro-level yet while screening out mortar particles from reaching the weep holes.

Again, the invention should cover the weep holes protecting them from any loose particles that could fall into them, acting as a screen or filter, without contributing any loose particles itself.

A further feature of the device is that it is shaped to allow it to fit against the drain and cover the weep holes in a manner compatible with the shape and function of the drain components. This feature allows the device to be installed quickly and easily into position without any preparation of the device or drain. Although there is some variation among manufacturers of drains as to the shape of the drain, the number and type of weep openings, the number of drain bolts, etc., the drainage device in its preferred embodiment would be designed to be universal. That is, it should fit satisfactorily against the drain neck, protect the weep holes, rest securely on the drain collar, and compensate in some manner for the protruding drain bolt heads on almost any manufacturer's double seepage drain.

This could be achieved with a single piece shaped in a circle or "donut" configuration which could be placed over the drain collar prior to placing the drain neck and drain top into the collar. Another method for the device would be to fabricate the device in more than one segment which could be placed around the drain after the top/neck of the drain were screwed into the collar. Another variation of the invention would be to fabricate the device as part of the drain itself, most likely as an integral part or component of the drain collar. Other variations are possible. A flexible version of the donut shape could be installed without removing the top/neck by cutting through one side of the donut so that the donut could be spread and bent in order to get it around the drain neck.

Although all the features work synergistically to make the device an attractive product to contractors, it is perhaps its convenience that is its greatest advantage. The benefit is not only to the installer because of its ease of use and availability, but also to the owner of the shower and to the tile industry as a whole, since better performing showers will improve the reputation of tile showers at large, causing them to continue and increase in construction.

One of the primary disadvantages of the loose aggregate method is the friable nature of the agrregate. A friable substrate will contribute to a friable mortar bed, which can create an unsatisfactory setting bed for the ceramic tile, resulting in the overlying floor tiles coming loose. Should such a tile come up, it may likely have some of the mortar bed still bonded to the back of it since the mortar was bonded to the tile but not bonded to anything substantially solid beneath. In fact there may even be some of the loose aggregate stuck to the bottom of the mortar.

The construction of the invention solves this problem in two ways. First, the aggregate are not loose, but are bonded interstitially to each other. Therefore the device provides a solid and stable backing for the mortar. Second, the device is continuous around a portion of the drain. This continuity provides a wide area for support and bond. The body of the device will extend beyond at least one edge of any overlaying tiles thereby helping to tie the whole area together. Unlike the loose aggregate method the device actually strengthens the mortar bed.

While the aggregate of the device are bonded interstitially they are graded by size in such a way so that there are many open spaces around each aggregate. This allows passage ways for water flow in any direction. The size of the aggregate chosen is very important. For optimal performance, the size of the aggregate must be large enough to leave interstitial open spaces between all of the aggregate even after each aggregate is coated with a layer of epoxy or some other type of resin. Too small of an aggregate would result in the open spaces being closed up by the resinous coating. (Resins discussed later in the summary.)

However too large of an aggregate will weaken both the device and the mortar bed, but in different ways. There must be enough interstitial bonding between the aggregate to give the device enough strength to practically hold up. Since the device may be less than one-half inch thick, aggregate much over one-eighth inch in diameter would not allow enough interstitial bonding to support the preferred device. Larger aggregate would also not support the mortar bed suitably at the micro-level. Note: Micro-level is defined as that tiny area of interaction where the small sand and cement particles interact with a single opening between two or more aggregate on the surface of the "body-of-agreggate". Macro-level is defined as the area including the overall interaction of the aggregate and the mortar bed.

As the mortar is placed against the larger aggregate the spaces between the aggregate are so large that the sand and cement fall through the aggregate. Although the mortar at a level substantially above the aggregate may be well packed, the mortar at the level of the aggregate is not. A continual change in density occurs the closer the mortar is to the large aggregate. The closer it is the looser it is, until the mortar that is actually within the large aggregate is either completely loose or so non-packed that it contributes nothing to the mortar bed and would actually contribute to cluttering up the interior of the device.

This "aggregate size" problem is compounded even further by the "loose" agregate method. First of all the tilesetters typically have little to choose from in the way of loose aggregate. They would normally choose from some sort of gravel or use broken tile chips. The size of the weep holes are usually at least one-fourth inch across. Any aggregate used which was smaller than the weep hole width would be likely to fall into the weep holes and possibly clog them or at the least partially obstruct them. Thus only a relatively large size would be practical which would lead to not only a low density compaction of the mortar bed near the aggregate as just discussed, but also a friable aggregate/mortar bed as was also previously discussed.

In addition the large loose aggregate would allow more loose particles of the mortar bed to be initially and subsequently formed which could flow through the aggregate and contribute to clogging the weep holes. Thus the large loose aggregate fails to support the structure at both the micro-level and the macro-level.

Another problem with the large loose aggregate is that the aggregate might not bridge the weep holes. If one aggregate was sitting on top of a weep hole, it could seal it off partially or completely at the top of the weep hole. As previously pointed out, the invention solves this problem by bridging over the weep hole yet still allowing free water flow access to it.

Using a smaller aggregate such as that acceptable for the invention but in a loose form will not solve the problem either. Piling loose small aggregate around the drain will still have the friable problem. In addition the small aggregate will fall through the weep hole with some of the aggregate washing on through and some of them contributing to clogging the weep holes. Some of the falling would occur after the mortar bed was in place. The void caused by the falling aggregate would contribute towards shifting and settling of the outer aggregate and mortar bed. This problem is also solved by the invention as already mentioned by eliminating any loose aggregate.

The invention supports the mortar bed at the micro-level and the macro-level. The interstitial bond is strong enough and the interstitial spaces are small enough to provide a firm support to the mortar bed at the micro-level to allow it to be packed hard and firm during the installation. This allows little or no loose mortar particles and yields a dense compaction at the micro-level. The size(s) of the aggregate used in the device are small enough so that at the micro-level the interstitial spaces allow just enough particles from the mortar bed to enter and lock in. In general the mortar particles do not pass beyond the first layer of aggregate at the surface of the device. The particles enter the first layers of spaces (cavities) and are compressed there creating a mortar bridge across the adjoining interstitial spaces. This results in multitudes of tiny mortar bridges throughout the surface of the device which act as points of entry for the water to enter the device from the mortar bed.

The dense compaction of the mortar bed at the micro-level in continuity across the surface of the device as a whole supports the macro-level yielding a strong, dense, intact, and non-shifting mortar bed.

A primary feature of the drainage device is that it be of sufficient size and surface area to adequately drain the mortar bed. This means the device should be large enough to provide a much greater surface area for water permeation than would be provided by the area of the weep holes alone.

An additional feature of the device is that it can be designed with spaces left open on the bottom side of the device to allow it to easily be installed over the drain bolt heads and provide permanent clearance of the device from the drain bolts. A further benefit of this design is that it should lengthen the life of the drain bolts by isolating them from constant submersion in wet mortar. Or an alternative version of the device would be to design it thinner and more flexible so that it would bend over the drain bolt heads yielding the same benefits of easy installation and isolation of the bolt heads.

One preferred embodiment of the invention would be a semicircular device with an inside radius of about 1½ inches and an outside radius of about 2½ to 3 inches. The device would be around ⅜ to ⅝ inch thick. The device would be composed of aggregate bonded together by a suitable process. If the aggregate were of a mineral type such as silica granules, the granules could be bonded together with an epoxy resin such as DER 325 from DOW Chemical of Freeport, Texas mixed with Versamine C-31 from Henkel Corporation of Ambler, Pa. at a ratio of 2 to 1. The most suitable aggregate sizes fall within the range of ⅛ inch to 1/40 inch in diameter (or average cross section of an aggregate perpendicular to its long dimension).

The epoxy is added at a proportion of around 1 to 25 or 35, to the granules depending on the size of the granules and their surface characteristics. The granules mixture is then aggitated to insure coverage of all surfaces of the granules with the resin mixture. When the granules are all coated with the epoxy, they should then be cast and pressed into a proper mold and allowed to cure. The cure should take about 24 hours at room temperature. A flexible mold should be used such as a rubber type made by mixing a two component urethane mixture together, and pouring it over a master prototype piece shaped like the final product would be shaped. A suitable rubber molding compound would be PMC-744. The two-component compound and references for using it can be obtained from Smooth-On Incorporated of Gillette, N.J.

The prototype should be made out of wood or plaster and coated with wax prior to pouring the urethane mixture over the prototype. This should result in obtaining an open face mold suitable for casting the resinous aggregate into the mold which could then be trowelled into a flat surface on top. The wax assists in releasing the rubber mold from the prototype after the mold has cured. The wax should also be coated on the inside of the mold thereafter in order to assist in releasing the epoxy/agregate mixture from the mold after the epoxy has cured. A suitable wax for these purposes is also available from Smooth-On Inc., or almost any industrial type mold release wax should work for the prototype release and the mold release.

The device prototype should be shaped into the final form desired including any and all grooves, slots or holes necessary so that the cured piece obtained from the mold will need little or no further shaping done to it. Depending on how complicated the piece is, the shape desired would be achievable with an open casting type mold as the one described. Holes or grooves may be designed into the prototype so that the device can rest flat on the drain collar without resting upon the drain bolt heads. The bolt heads raise above the collar on most drains and without a space shaped into the bottom of the device (or other means) to allow for the bolt heads then the device would not be able to rest on the collar. This would be unsatisfactory as the device would not be supported properly nor would it be able to adequately protect the weep holes from mortar bed particles.

Two of these semicircular devices would be placed around the drain in order to have the collar completely covered all the way around the drain. However, if desired the device could be made out of more than two segments, with each segment covering a portion of the collar. The bottom of the device would cover the top of the collar and the weep holes. The inside edge of the device would would lay adjacent to the drain neck, while the outside edge would lay near the edge of the drain collar.

Several variations of the device could be made that would still embody the invention. Many types of granules could be used as a suitable aggregate. Such granules could include but are not limited to plastic, rubber, recycled products, glass and many types of minerals both natural and man-made. The granules could be beads, balls, irregularly shaped material, fibers, shredded material or other possibilities.

The granules could be bonded together with epoxy as mentioned or by any other suitable means. Other methods possible include but are not limited to other thermoset type resins such as other epoxy combinations or urethanes. The granules could be bonded together by heat fusion if they were plastic or glass. Various other types of bonding exist that entail heating or catalyzing polymers etc., that could be used as a whole or part of the device.

Although the casting process as described would be conductive to forming with thermoset resins, the method of making the device could be done in some other way and still achieve the object of the invention.

The epoxy granule mixture described could result in a rigid or semi-rigid device, depending on the choice of resins and granules. The latitude in rigidity and flexibility available is even broader if using two-component 100% solids urethane resins in lieu of epoxy resins. The type of urethane resin and hardener chosen would be dependent upon the rigidity and hardness desired in the device. Such urethanes and counsel on appropiate resins, hardeners and procedures can be obtained from companies like Mobay Corporation in Pittsburgh, Pa.; ICI Polyurethanes Group, in Deptford, N.J.; or Dow Chemical, Polyurethanes Group in Midland, Mich.

While flexibility of the device is desirable because of its advantages of having good shock resistance and possible ease of installation, excessive flexibility could lead to insufficient support for the mortar bed. The degree of flexibility and hardness chosen should be one that will be conducive to a strong mortar bed. Added flexibility would also allow making an altered version of the device capable of being made thinner and substantially wider, and still be packaged and handled without being broken. However any change in thickness or flexibility should be tested to be sure the device will adequately support the mortar bed.

Other and further objects, advantages, and features of the present invention will be understood by reference to the following specification in conjunction with the annexed drawings, wherein like parts have been given like numbers.

4. BRIEF DESCRIPTION OF THE DRAWINGS

FIG. 1. Preferred embodiment of the device in its "collar-covering" version.

Figure 2:
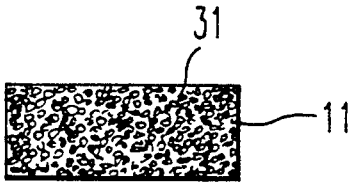

FIG. 2. Cross section of the "collar-covering" device.

Figure 3:
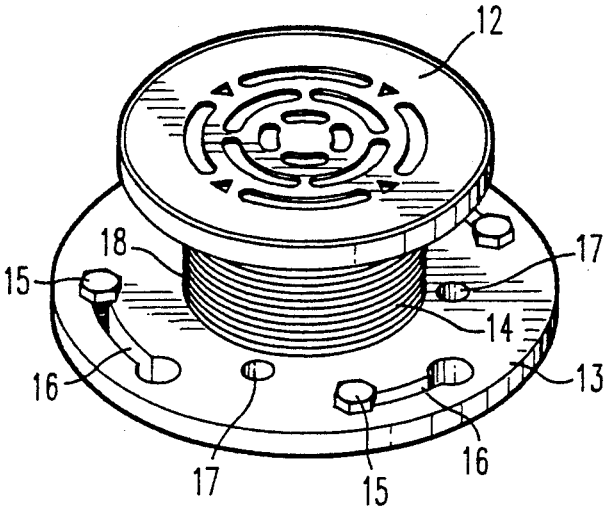

FIG. 3. Depiction of a typical double seepage drain collar and top/neck.

Figure 4:
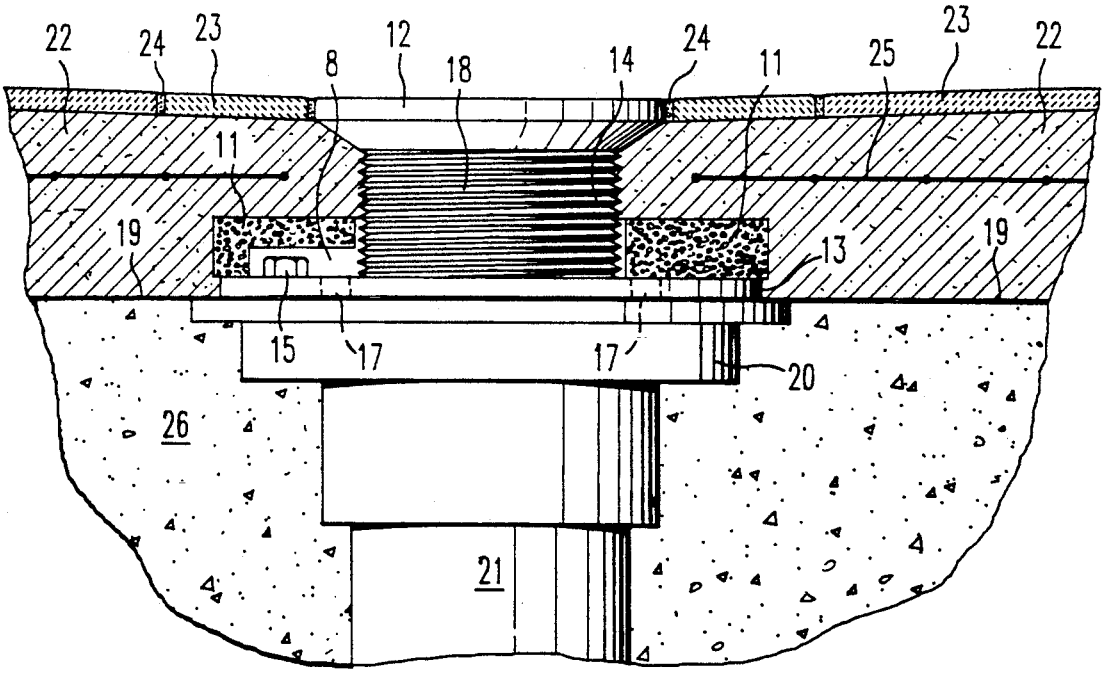

FIG. 4. Cross section of a typical shower floor depicting various components.

Figure 5:
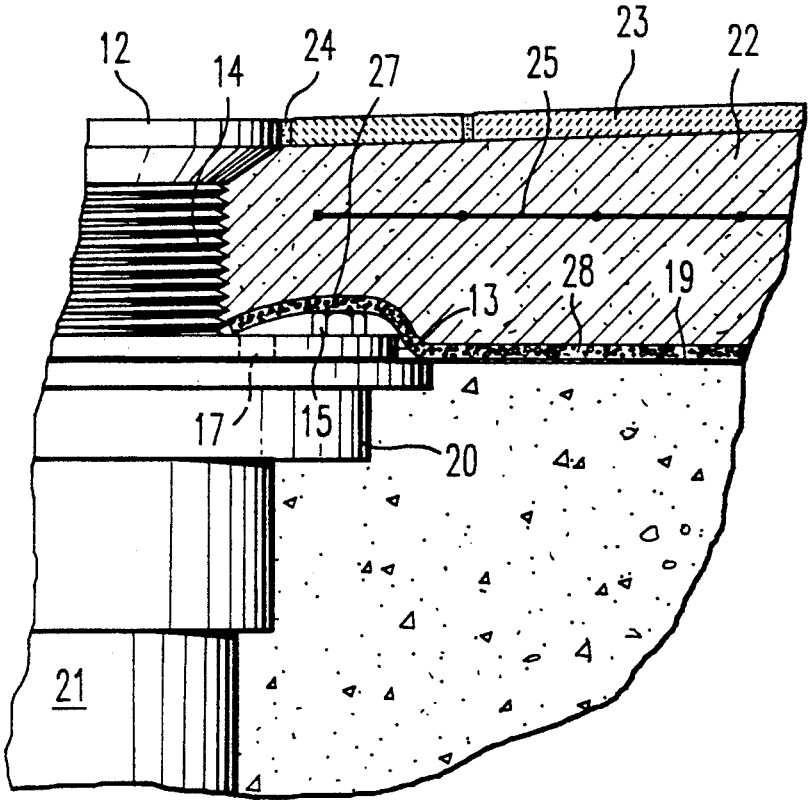

FIG. 5. Cross section depicting a thin flexible version of the invention in relation to its placement around a double seepage drain.

Figure 6:
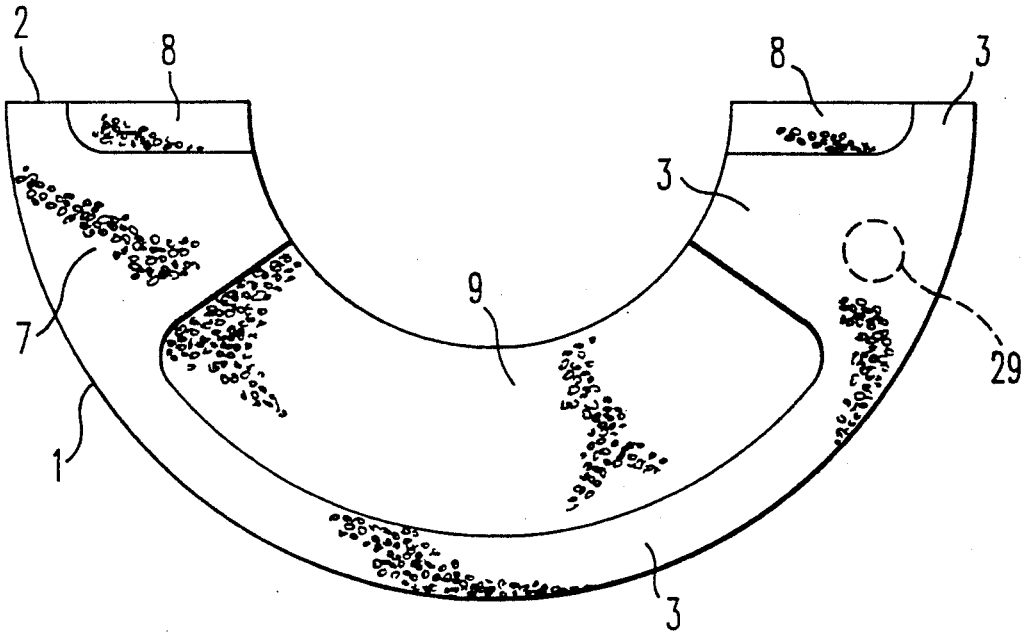

FIG. 6. View of a possible bottom surface of the "collar-covering" version of the invention.

Figure 7:
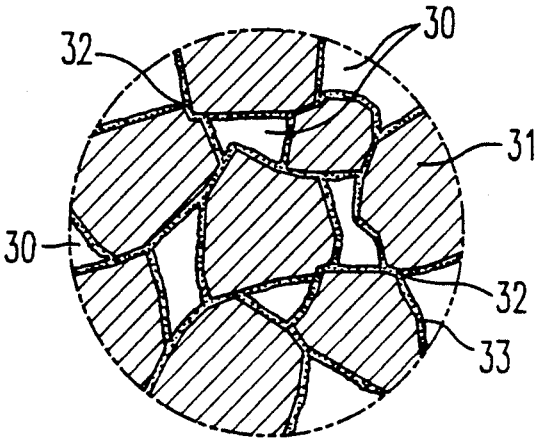

FIG. 7. Enlarged view of interstitial bonding of aggregate and interstitial spaces.

5. DETAILED DESCRIPTION OF THE INVENTION

The preferred embodiment of the device in its semicircular thick version 1 is shown in FIG. 1. FIG. 1 shows the inside face 4 of the device which fits adjacent to the drain neck 14 as depicted in FIG. 3 and FIG. 4. The outside face 5, the top surface 6, the bottom of the device 7, and the end faces of the device 2 are also depicted. The supporting sections 3 support the device 1 by resting on the drain collar 13 while the end notched areas 8 and the large notched area 9 allow for the protruding drain bolt heads 15 protruding from the collar 13. The end notch areas 8 cover approximately one-half of the top of a drain bolt head 15, while the opposing semicircular device 1 covers the other half of the drain bolt head 15.

Most double seepage drains are composed of 3 parts. The body-with-attached-flange 20, collar 13 and the top 12/neck 14. The collar 13 creates a seal with the shower pan 19 by tightly compressing the shower pan 19 between the collar 13 and the body flange 20. The tight compression is accomplished by screwing bolts through the collar and into the female threaded bolt holes in the flange. Most double seepage drains are designed with either three or four bolts. With the three bolt drain the bolts are placed 120 degrees apart around the circumference of the collar 13. The bolts are placed 90 degrees apart on a four bolt drain.

The drainage device 1 is designed to be universal in that it will fit over the drain bolt heads 15 on either the three or the four bolt drains. The end notch areas 8 will cover two of the bolt heads 15 on a four bolt drain and one of the bolt heads 15 on a three bolt drain. The large notch area 9 will cover the other two bolt heads 15 on either drain type. It takes two of the semicircular drainage devices 1 to cover the bolt heads 15 that are under the large notched area 9 of each device. That is, each device covers one bolt head 15 under its large notched area 9.

On a four bolt drain the bolt under the large notch 9 is generally located in the center of the large notch 9. Whereas the bolt under the large notch 9 on a three bolt drain is generally located 30 degrees off of center circumferentially. Thus the semicircular device 1 will accomodate the bolt heads 15 whether they are 90 degrees apart or 120 degrees apart, due the combination effect of the smaller end notches 8 and the large notched areas 9 of two semicircular devices 1. The sizes, quantities and shapes of these notches can be altered and still achieve the object of this invention.

The top of the drain 12 and the drain neck 14 are usually fabricated as one component. The neck 14 normally has male threads 18 on its side to enable it to screw into the collar 13. The threads 18 allow the height of the top 12 to be adjusted up or down.

FIG. 3 further depicts a typical location of weep holes 17 located through the collar 13. Also shown are the drain bolt heads 15 and drain bolt slots 16. The slots 16 are designed into some manufacturers drains to simplify taking the collar 13 off of the body/flange 20 without having to completely remove the bolts.

FIG. 2 shows a typical cross section 11 of the device 1 through an area of the device 1 that does not contain a notch 8,9. The aggregate 31 are shown bonded together interstitially in the device 1. Another cross section of the device 11 depicting the notched areas 8,9 is visible in FIG. 4 on the left hand side of the drain. The notched area 8 is quite plainly shown allowing clearance for the drain bolt head 15. The right hand side shows what a cross section 11 would look like resting firmly on the collar 13 in an area where the notches 8,9 do not occur. The cross section is shown this way for illustration purposes and may not accurately reflect actual positions of bolt heads 15, notches 8,9 or weep holes 17 in relation to each other. The weep holes 17 are shown draining the drainage device into the drain body 20.

FIG. 4 shows a typical shower floor construction in the area of the double seepage drain. The floor substrate 26 is shown with lack of detail since the type of floor substrate can vary and is irrelevant to the invention. The sewer pipe 21 and drain body/flange 20 are also not given much detail because the shape varies somewhat among the manufacturers but they all perform the same basic functions.

Other components shown are the ceramic floor tiles 23 and the grout joints 24 between the tiles. The thinset bonding material which bonds the tiles 23 to the mortar bed 22 is not shown. The reinforcing mesh 25 is shown as a cross section. The bumps in the mesh 25 indicate the position of the wires which are running perpendicular to the wire shown running across the drawing.

The mortar bed 22 is shown as filling the area between the shower pan 19 and the overlaying tiles 23 and being placed against the drainage device cross section 11 and the drain neck 14.

FIG. 6 depicts the bottom surface of the device 1 showing possible locations of the end notches 8 and the large notch 9. The width of large notch 9 is wide enough to enclose the drain bolt head 15 whether it is 90 degrees off of a bolt head 15 located at end notch 8 or whether it is 120 degrees off of a bolt head 15 located at either end notch 8.

FIG. 7 is an enlarged view of a small area 29 of the device 1 (shown in FIG. 6), showing a typical interstitial bond 32 between the aggregate 31, the interstitial spaces 30 thus formed, and the resinous coating 33 which forms the interstitial bond 32. FIG. 7 is not necessarily drawn to scale, nor should the shapes or proportions of the aggregate and interstitial spaces be limited to those shown in the drawing. The interstitial spaces 30 allow fluid flow in any direction through the device including lateral flow horizontally along the surface of the shower pan 19 which would be an advantage of the thin flexible version of the preferred device 28 as shown in FIG. 5.

FIG. 5 shows a thin flexible version of the preferred drainage device 28. The thin drainage device 28 is flexible enough to make a bend 27 over the bolt head 15 allowing it to still cover the collar 13 and the weep holes 17. Because the thin flexible drainage device 28 is non-fragile it is practical to make the thin device 28 capable of covering a larger area of the shower pan 19, thereby creating a greater surface area at the bottom of the mortar bed 22 thereby maximizing the drainage of the mortar bed 22 and the efficiency of the device. The weight of the mortar bed 22 (not shown in FIG. 5) would hold the bend 27 in position. The thin device 28 preferably should not be so flexible as to make a bend 27 and lay over the drain bolt head without outside pressure such as the mortar bed 22 packed against it.

The thin flexible device 28 would have as one of its greatest advantages the ability to drain a wide area furnishing a broad base on top of the shower pan 19 for rapid drainage to the weep holes 17. In addition to providing a much greater surface area of mortar bed 22 exposed to drainage, the device 28 drains portions of the mortar 22 located a distance away from the drain yet located over the device 28, much more rapidly than a device located just over the collar 13. The device in effect provides a rapid flow-way for the mortar bed 22 located a distance away from the drain rather than relying on the slow lateral flow of the fluid through the mortar bed 22 itself.

While the invention has been shown and described in its preferrable forms it is not thus limited but is susceptible to various changes and modifications without departing from the spirit thereof.

I claim:

1. A floor drainage device for use with a shower floor having a drain of the type having a drain body for attachment to a drain pipe, a drain neck including an open top end defining a drain opening and a drain neck collar for attaching the drain neck to the drain body, at least one of the drain neck and collar including drainage weep holes, the shower floor including a shower pan sealingly positioned between the collar and drain body and a porous mortar bed positioned on the pan and around the drain neck, said drainage device comprising:

an encircling member having a central opening for allowing the member to be positioned around the drain neck, said encircling member being constructed of a material having a greater porosity than that of the mortar bed and being sized to be positioned between the weep holes and the mortar bed such that substantially all water seepage through the mortar bed must pass through said encircling member before entering the weep holes;

whereby, said encircling member enhances water seepage drainage through the mortar bed by providing a greater drainage surface area of the mortar bed than that provided by the weep holes alone.

2. The drainage device as defined in claim 1, wherein said encircling member is constructed as a plurality of sections.

3. The drainage device as defined in claim 1, wherein said encircling member includes notched areas formed in an underside thereof to accommodate bolt heads of bolts used to attach the collar to the drain body.

4. The drainage device as defined in claim 3, wherein said porous material has sufficient rigidity to allow firm packing of the mortar bed.

5. The drainage device as defined in claim 1, wherein said porous material is flexible.

* * * * *